United States Patent [19]

Ackermann et al.

[11] Patent Number: 4,817,544

[45] Date of Patent: Apr. 4, 1989

[54] HEMMING DEVICE WITH HEMMING GUIDE AND GUIDE MEMBER FOR A SEWING MACHINE

[75] Inventors: Manfred Ackermann, Elmhurst; Franklin V. Narbert, Chicago, both of Ill.

[73] Assignee: Union Special Corporation, Chicago, Ill.

[21] Appl. No.: 87,718

[22] Filed: Aug. 20, 1987

[51] Int. Cl.[4] ..... D05B 35/02

[52] U.S. Cl. ..... 112/141; 112/153

[58] Field of Search ..... 112/140, 141, 177, 153

[56] References Cited

U.S. PATENT DOCUMENTS

| | | | |
|---|---|---|---|
| 1,941,452 | 1/1934 | Washburn et al. | 112/177 |
| 2,233,088 | 2/1941 | Washburn et al. | 112/177 |
| 2,434,619 | 1/1948 | Knaus et al. | 112/177 |
| 2,518,340 | 8/1950 | Levine et al. | 112/141 |
| 2,880,685 | 4/1959 | Gardner | 112/141 |
| 4,337,713 | 7/1982 | Palacino et al. | 112/153 |
| 4,512,270 | 4/1985 | Nozaki | 112/140 |
| 4,590,872 | 5/1986 | Bray | 112/121.12 |

FOREIGN PATENT DOCUMENTS

| | | |
|---|---|---|
| 2130377 | 12/1971 | Fed. Rep. of Germany . |
| 5438545 | 11/1979 | Japan . |

*Primary Examiner*—Andrew M. Falik

*Attorney, Agent, or Firm*—Emrich & Dithmar

[57] ABSTRACT

A sewing machine for sewing a fabric comprising, a reciprocating needle, a hemming device comprising a guide member having an edge guide extending towards the needle, and an elongated hemming guide extending laterally from the guide member and including a device for retaining the fabric in a folded configuration passing towards the needle. The sewing machine has a device for sensing passage of a cross-seam of the fabric as it passes along the guide member, a device responsive to the sensing device for shifting the guide member and hemming guide along with the fabric laterally away while the needle penetrates the fabric in the region of the cross-seam, and a device for returning the guide member and hemming guide along with the fabric to its original position.

19 Claims, 5 Drawing Sheets

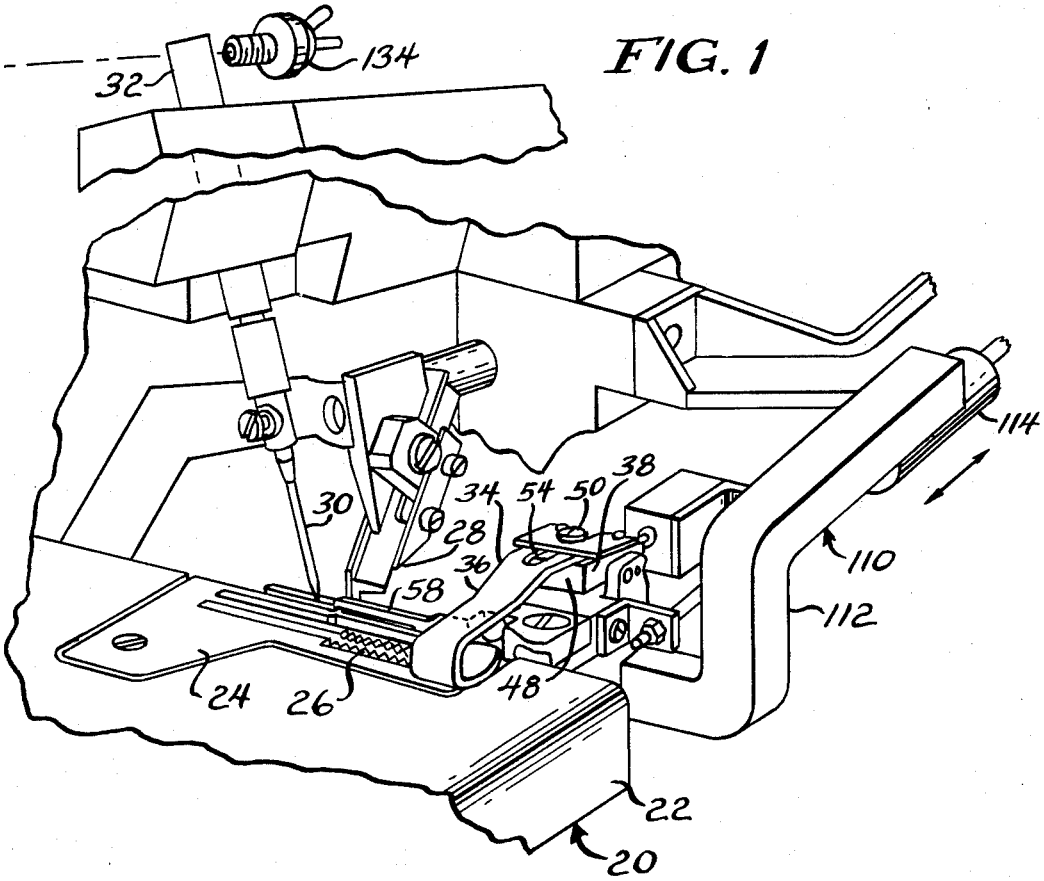
FIG. 1
FIG. 2
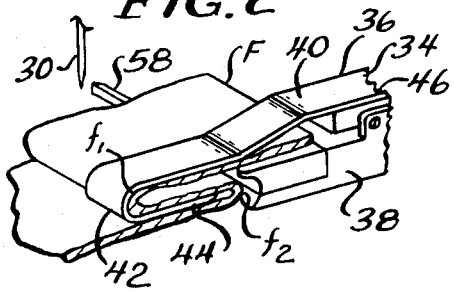
FIG. 3
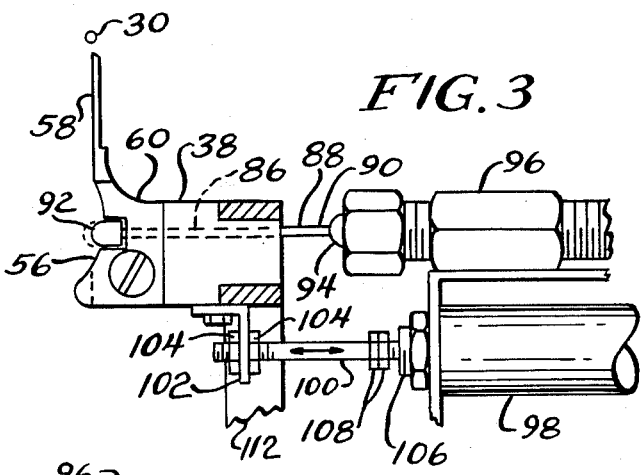
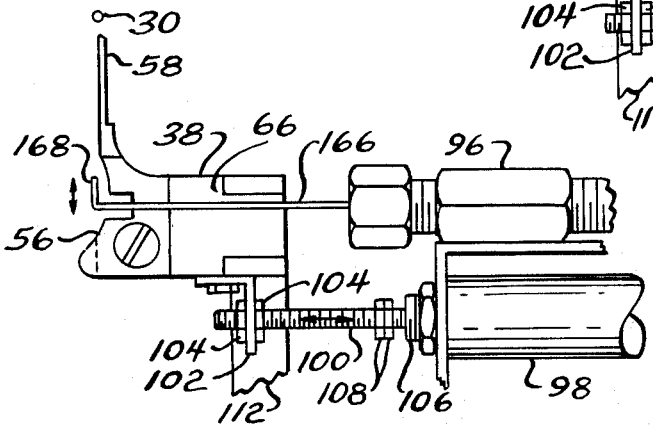
FIG. 4

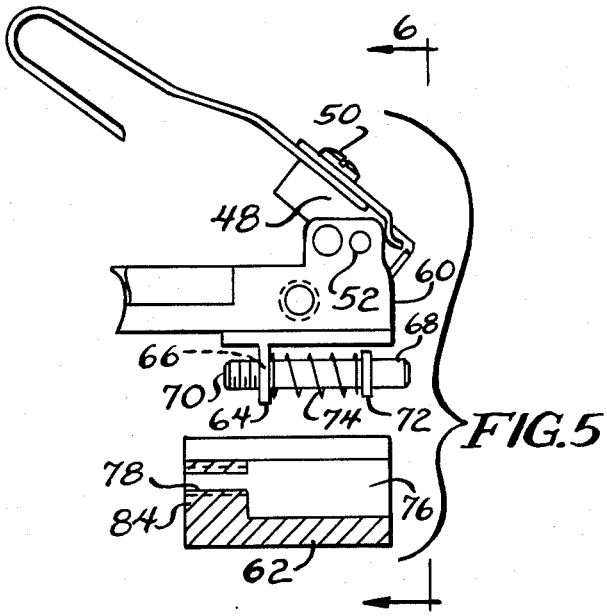
FIG. 5
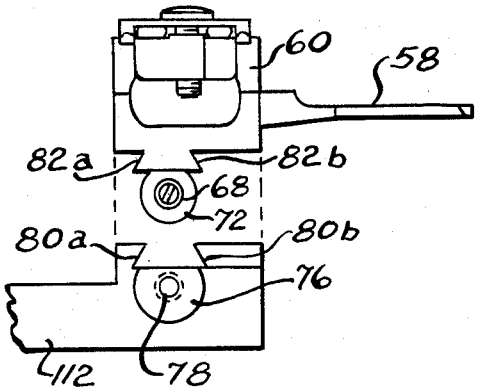
FIG. 6
FIG. 7
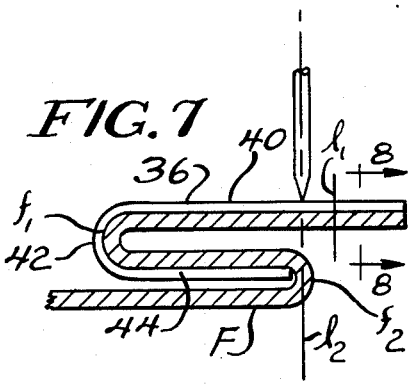
FIG. 9
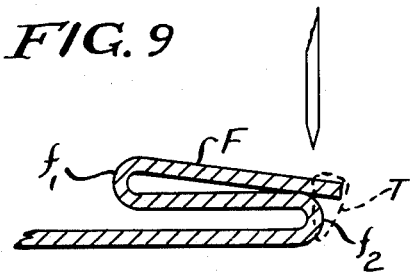
FIG. 8
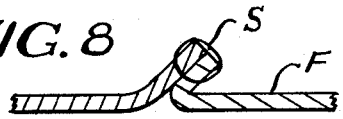
FIG. 10
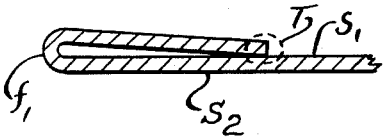
FIG. 11
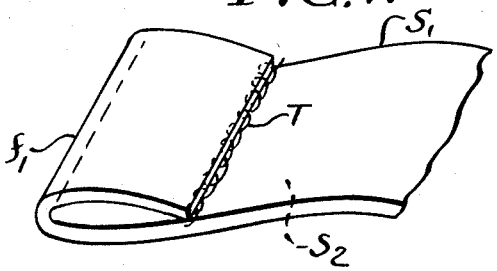
FIG. 12
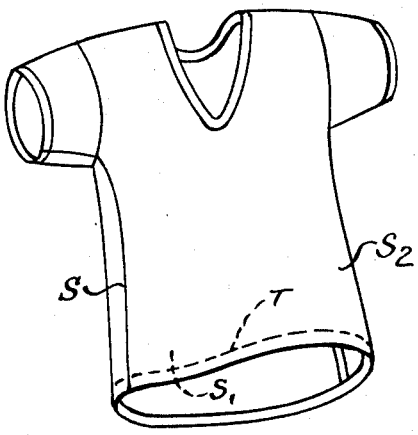

HEMMING DEVICE WITH HEMMING GUIDE AND GUIDE MEMBER FOR A SEWING MACHINE

BACKGROUND OF THE INVENTION

The present invention relates to hemming devices for sewing machines.

A hemming guide control is disclosed in U.S. Pat. No. 4,512,270, incorporated herein by reference. In this patent, a sewing machine is disclosed for forming a blind stitch on a fabric which is supposed to assure stitching of the fabric just forward of and behind a cross seam by moving a fabric guide surface 20 away from the seam. However, during this time control of the fabric is lost, and the fabric is left to find its own way.

A stitch hemming device for tubuler material is disclosed in U.S. Pat. No. 4,337,713, incorporated herein by reference.

SUMMARY OF THE PRESENT INVENTION

A principal feature of the present invention is the provision of a hemming device for sewing machines.

The sewing machine of the present invention cmoprises, a reciprociting needle, and a hemming device comprising a guide member having an edge guide extending towards the needle, and an elongated hemming guide extending laterally from the guide member and including means for retaining the fabric in a folded configuration passing towards the needle. The sewing machine has means for sensing passage of a cross-seam of the fabric as it passes along the guide member.

A feature of the present invention is that the sewing machine has means responsive to the sensing means for shifting both the guide member and the hemming guide along with the fabric laterally away from the needle while the needle penetrates the fabric in the region of the cross-seam.

Another feature of the invention is that the sewing machine has means for returning the guide member and hemming guide along with the fabric laterally to its original position.

Thus, a feature of the invention is that the sewing machine maintains positive control of the fabric during the shifting operation to assure proper formation of the stitch pattern in the fabric.

A further feature of the invention is the provision of means for adjusting the lateral position of the hemming guide relative to the guide member.

Another feature of the invention is the provision of means for adjusting the lateral distance the guide member and hemming guide are shifted.

A further feature of the invention is the provision of means for counting reciprocations of the needle and delaying the shifting and returning operations.

Still another feature of the invention is the provision of pneumatic switch means responsive to the sensing means.

Further features will become more fully apparent in the following description of the embodiments of this invention and from the appended claims.

DESCRIPTION OF THE DRAWINGS

In the drawings:

FIG. 1 is a perspective view of a sewing machine having a hemming device of the present invention;

FIG. 2 is a fragmentary perspective view of a hemming guide for the hemming device of FIG. 1;

FIG. 3 is a fragmentary plan view of a portion of a guide member for the hemming device of FIG. 1;

FIG. 4 is a fragmentary plan view of another embodiment of the guide member;

FIG. 5 is an exploded elevational view, taken partly in section, of the hemming device;

FIG. 6 is fragmentary elevational view taken from the right side of FIG. 5;

FIG. 7 is a diagrammatic view illustrating the configuration of fabric prior to formation of a blind stitch in the fabric;

FIG. 8 is a sectional view of the fabric taken substantially as indicated along the line 8—8 of FIG. 7;

FIG. 9 is a diagrammatic view of a blind stitch sewn into the fabric;

FIG. 10 is a diagrammatic view showing a hem formed in the fabric by a blind stitch;

FIG. 11 is a perspective view showing the hem;

FIG. 12 is a perspective view showing a garment having a hem formed by the blind stitch pattern;

DESCRIPTION OF THE PREFERRED EMBODIMENTS

Figure 13:
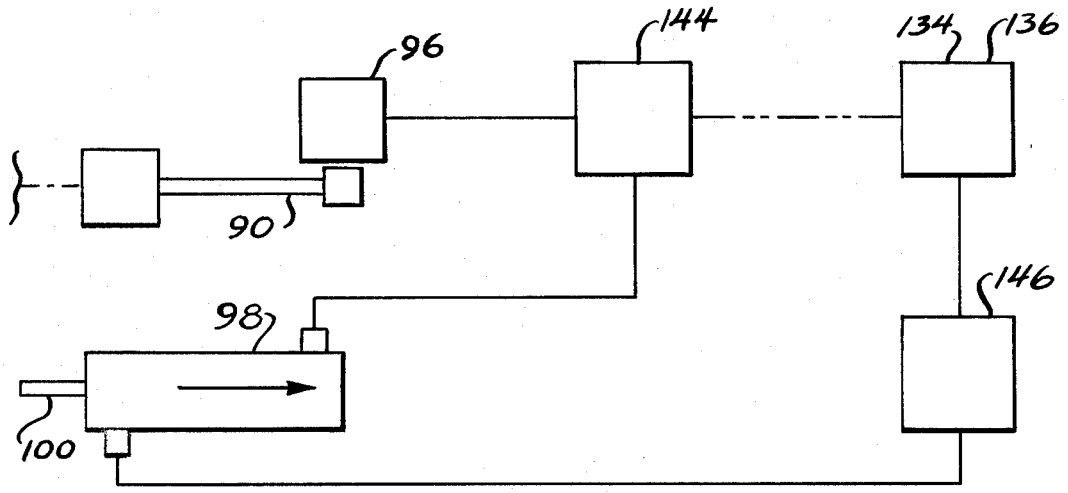
FIG. 13 is a diagrammatic view of a control system for the sewing machine of the present invention.

Refer now to FIGS. 1–3, there is shown a sewing machine generally designated 20 having a housing 22, a throat plate 24, a feed dog 26, a conventional cutting device 28, a reciprocating needle 30, and a needle bar 32 which reciprociates along with the needle 30. The sewing machine may be a two thread overedge machine of Federal Stitch Type 503-FFc-1.

The sewing machine has a hemming device 34 having an elongated hemming guide 36 and a guide member 38. With reference to FIGS. 1–3, 5, and 6, the hemming guide has an elongated lateral upper portion 40, an arcuate portion 42 adjacent one end of the hemming guide 36, and a lower turned end portion 44 directed toward the guide member 38. The other end 46 of the lateral portion 40 is secured by a screw 50 to a block 48 which is pivotally mounted by a pin 52 to an upper portion of the guide member 38. The screw 50 is received in a slot 54 of the lateral portion 40, such that the hemming guide 36 may be adjusted laterally relative to the guide member 38. Since the hemming guide 36 is pivotally mounted to the guide member 30, the hemming guide 36 may be raised to permit insertion of a fabric in the hemming guide 36, as shown in FIG. 5, after which the hemming guide 36 may be lowered to operative position, as shown in FIGS. 1 and 2.

The guide member 38 has an arcuate forward recess 56, and an elongated edge guide 58 which extends to a location adjacent the needle 30. As shown in FIGS. 5 and 6, the guide member has an upper guide portion 60, and a lower base portion 62. The guide portion 60 has a lower plate 64 with an opening 66 to slidably receive a bolt 68 having a threaded end 70 and a collar 72, with a helical spring 74 being received on the bolt 68 and extending between the plate 64 and collar 72. The base portion 62 has a cut-out 76 to receive the plate 64 and bolt 68, and a threaded bore 78 to receive the threaded end 70 of the bolt 68. The base portion 62 has a pair of opposed tapered groves 80*a* and 80*b* to slidably receive a pair of opposed tapered flanges 82*a* and 82*b* of the guide portion 60, such that the guide portion 60 is slidably mounted in the base portion 62. In this configuration, the spring biases the plate 64 and guide portion 60 towards the left, as viewed in FIG. 5, toward an end portion 84 of the base portion 62, and the guide portion 60 may move towards the right, as viewed in FIG. 5, towards the bolt collar 72 of the bolt 68 against the biasing of the spring 74. The amount of force exerted by the spring 74 against the plate 64 may be adjusted by turning the bolt 68 in the bore 78, such that the distance between the bolt collar 72 and plate 64 may be modified.

With reference to FIG. 3, the guide member has an elongated bore 86 to slidably receive the stem 88 of a sensing member 90, with the sensing member 90 having a head 92 being movable between an outer normal first position, as shown in dotted lines, and an inner actuated second position as shown in solid lines. The stem 88 of the sensing member 90 engages against the ball 94 of a pneumatic switch 96 which normally biases the sensing member 90 to the first normal position, and when the sensing member 90 is moved to the second position, the stem 88 actuates the switch 96 through the ball 94. The switch 96 may be of the type Model No. HTB-30 sold by Mead Fluid Dynamics of Chicago, Ill.

The sewing machine 20 has a cylinder 98 having a threaded movable piston 100. The guide member 38 has an L-shaped bracket 102 which is fixedly secured to the piston 100 by a pair of threaded nuts 104. The cylinder 98 has a collar 106 at the piston end, and the piston 100 has a pair of threaded nuts 108 received on the piston 100 such that their location may be modified relative to the collar 106 and may be locked in place. In operation, the cylinder 98 retracts the piston 100 and moves the guide portion 60 relative to the base portion 62 until the nuts 108 strike the collar 106. Thus, the distance the cylinder 98 retracts the guide portion 60 and attached edge guide 58 may be modified by adjusting the location of the nuts 108 on the piston 100, with a typical retaction distance being in the range of 0.010 to 0.015 inches.

Figure 18:
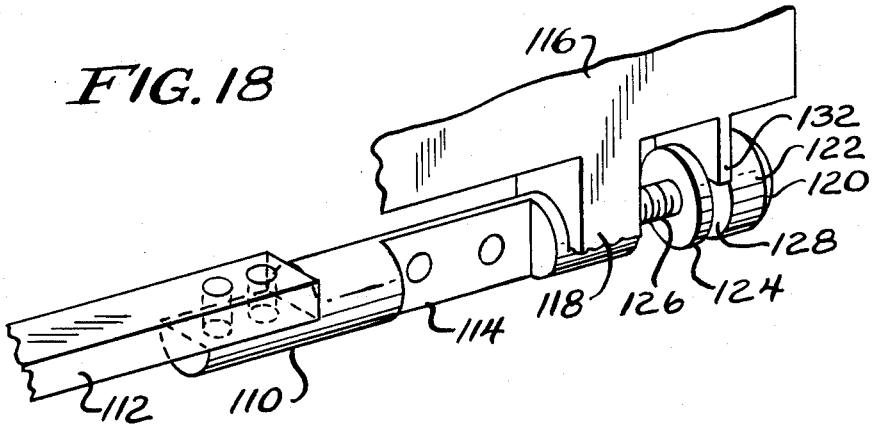
FIG. 18 is a fragmentary perspective view of an adjustment device for the hemming device.
Figure 19:
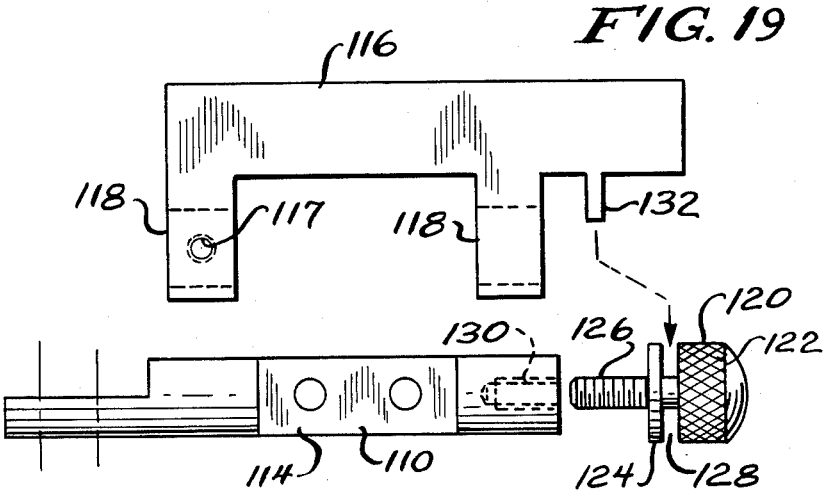
FIG. 19 is an exploded elevational view of the adjustment device of FIG. 18.

With reference to FIGS. 1, 18, and 19 the sewing machine 20 has an adjustment device 110 having one end of an elongated bar 112 secured to the base portion 62 of the guide member 38 and the other end of the bar 112 secured to a rod 114. The device 110 has a bracket member 116 secured to the sewing machine housing 22, and the rod 114 is slidably received in arms 118 of the bracket member 116. The device 110 has an adjustment member 120 having a knob 122, a circular plate 124, and a threaded screw 126, with the knob 122 and plate 124 defining an annular groove 128, and with the screw 126 being received in a threaded bore 130 of the rod 114. The bracket member 116 has a finger 132 received in the groove 128 to retain the adjustment member 120 in place while it is free to rotate. When the adjustment member 120 is turned, the screw 126 causes the rod 114 and bar 112 to move which in turn drives the guide member 38 and edge guide 58 relative to the needle 30. In this manner, the lateral position of the edge guide 58 and hemming device 34 may be adjusted through rotation of the knob 122. The bracket member 116 has a screw 117 for locking the rod 114 and adjustment device 110 in place once it is adjusted.

With reference to FIG. 1, the sewing machine 20 may have a switch 134 of known type, such as an air limit switch Part No. 1022, sold by Northeast Fluidies, Inc. The switch 134 senses reciprocation of the needle bar 32 in synchronization with the reciprocating needle 30, and generates a signal during each reciprocation thereof.

Figure 17:
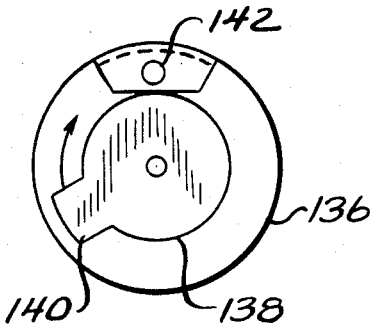
FIG. 17 is a plan view of a synchronizer in a handwheel of the sewing machine.

Alternatively, with reference to FIG. 17, the sewing machine 20 may have a synchronizer 136 having a plate 138 which rotates once for each reciprocation of the needle 30. The plate 138 has an extension 140 which passes beneath a photodetector 142 which generates a signal in response to sensing the extension 140 beneath the photodetector 142.

During sewing, with reference to FIGS. 2 and 7, the fabric F is folded in the hemming guide 36 about fold line $f_1$, with an upper end portion of the fabric F extending past the location of the edge guide 58 and needle 30, and with a lower portion of the fabric F being folded about fold line $f_2$ at the end of the hemming guide 36 and being located beneath and extending beyond the hemming guide 36. As the fabric F approaches the needle 30, the edge guide 58 guides the fabric F along the fold line $f_2$, the cutting device 28 cuts the fabric F along the line $l_1$, above the fold line $f_2$, and the needle 30 penetrates the fabric F along the line $l_2$ through the upper fabric layer and through a central portion of the fabric adjacent the fold line $f_2$ in order to form the blind stitch pattern shown in FIG. 9, with the thread T extending around the cut edge of the fabric F through the upper layer of fabric, and through the central portion of the fabric F adjacent the fold line $f_2$. Thus, with reference to FIGS. 10–12, when the sewn hem is unfolded, the stitch pattern appears on only surface $S_1$ of the garment while it does not appear on the opposed surface $S_2$ of the garment.

Although such a blind stitch may be formed in this manner, difficulties take place when a cross-seam S, as shown in FIG. 8, is placed against the edge guide 58, since the fabric F is moved away from the edge guide 58 by the cross-seam, and the needle 30 will only partially penetrate the fabric F adjacent the cross-seam or not at all resulting in unsatisfactory sewing of the fabric adjacent the cross-seam. The present invention relates to a sewing machine which solves this problem in an improved manner.

With reference to FIGS. 1–3, when the cross-seam S of the fabric F strikes the head 92 of the sensing member 90, the cross-seam S moves the sensing member 90 from the first to second position, and actuates the switch 96. With reference to FIG. 13, the actuated switch 96 generates a signal to a variable time delay 144 which generates a signal to turn the proximity switch 134 or synchronizer 136 on to generate signals in synchronism with the reciprociting needle 30. The time delay counts the number of stitches after the switch 96 is actuated, and generates a signal to actuate the cylinder 98 to retract the edge guide 58 and hemming guide 36 approximately 5 stitches before the cross-seam S reaches the needle. It is necessary to count stitches since the material travels at different rates. The switch 134 or synchronizer 136 generates signals to a second longer time delay 146 which counts stitches, and generates a signal to the cylinder 98 when the cross-seam S is located approximately 5 stitches past the needle in order to return the edge guide 58 and hemming guide 36 to its original home position. Of course, the head 92 of the sensing device 90 returns to its first position after the cross-seam passes the head 92.

In this manner, the edge guide 58 and hemming guide 36 are shifted when the cross-seam S is in the vicinity of the needle 30 to assure proper penetation of the fabric F by the needle 30 in the region of the cross-seam S while forming the hem. During this time, the hemming device 34 maintains positive control of the fabric F since the fabric is being retained in the shifted hemming guide 36.

Figure 14A:
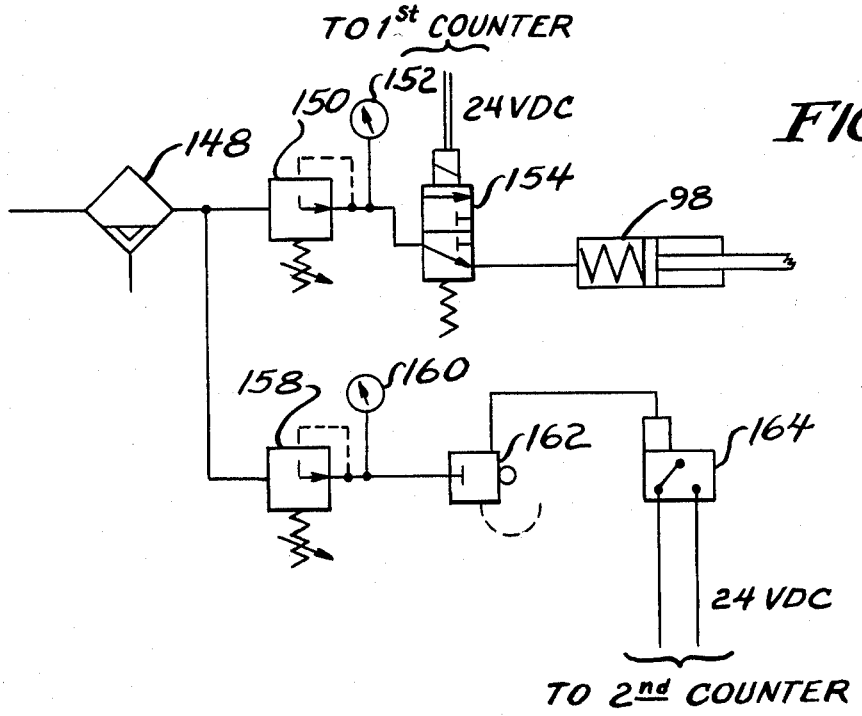
FIGS. 14*a* and 14*b* are diagrammatic views of a control system for the sewing machine of the present invention.
Figure 14B:
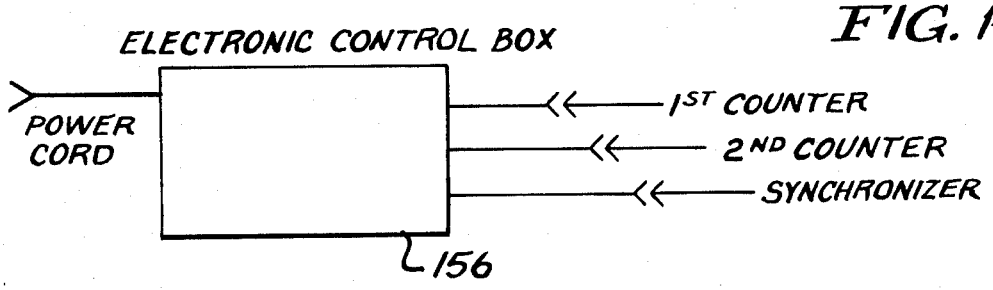

With reference to FIG. 14*a*, an air supply is connected to a filter 148 which removes water and particles from the air. The filter 148 is connected to a first regulator 150 and gauge 152 which controls the air flow to a solenoid valve 154. The valve 154 receives a signal from a first counter in an electronic control box 156 shown in FIG. 14*b* which counts revolutions of the sewing machine 20 from the time the cross-seam is sensed to the time it is desired to shift the hemming device 34 when the valve 154 actuates the cylinder 98. With reference to FIG. 14*a*, the air from the filter 148 also passes to a second regulator 158 and gauge 160 which controls air flow passing to a sensor 162 described in connection with FIGS. 15 and 16 below. When the sensor detects the cross-seam S, it actuates a penumatic switch 164 which generates a signal to turn on the first counter and a second counter in the control box 156 of FIG. 14*b*. The second conter counts revolutions of the sewing machine 20 as determined by the switch 134 or synchronizer 136. When the second counter has determined that sufficient stitches have been made, it activates the cylinder 98 to return the hemming device 34 to its original home position. As shown, the control box 156 is energized by a power cord.

Another embodiment of the present invention is illustrated in FIG. 4, in which like reference numerals designate like parts. In this embodiment, the switch 96 has an elongated thin rod 166 extending through the guide member 38, with an outer end portion 168 being directed towards the needle 30. Deflection of the rod 166 by the cross-seam towards the needle 30 actuates the switch 96. The switch 96 and rod 166 may be of the type Part No. HTW-30 sold by Mead Fluid Dynamics of Chicago, Ill. In other respects, the sewing machine 20 operates as previously described.

Figure 15:
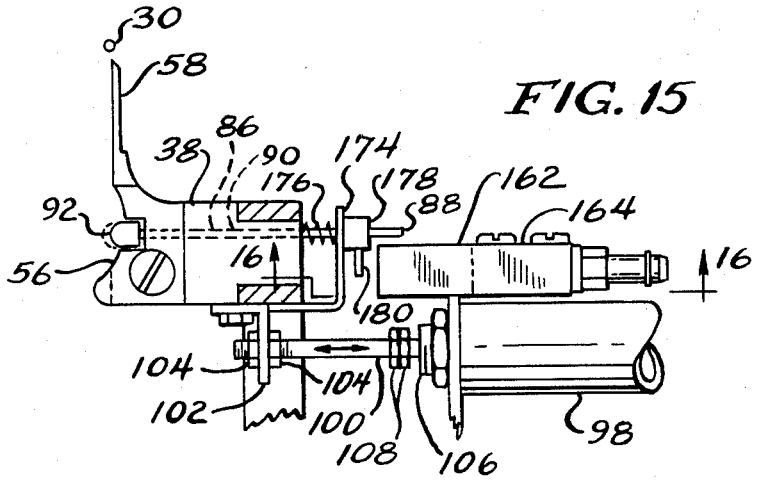
FIG. 15 is a fragmentary plan view of another embodiment of a hemming device for the sewing machine of the present invention.
Figure 16:
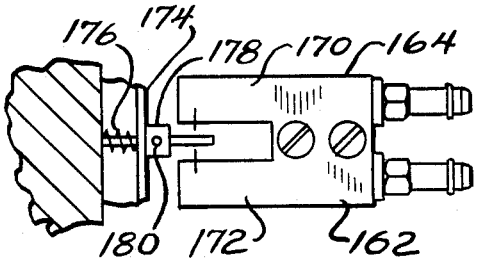
FIG. 16 is a fragmentary elevational view of the hemming device taken substantially as indicated along the line 16—16 of FIG. 15.

Another embodiment of the present invention is illustrated in FIGS. 15 and 16, in which like reference numerals designate like parts. In this embodiment, the sewing machine has the sensor 162 previously described in connection with FIG. 14*a*. The sensor 162 has a pair of tines 170 and 172 between which air flows between opposed openings in the inner part of the tines 170 adn 172, and the switch associated with the sensor 162 comprises means for passing gas between the tines and is actuated when the air flow is interrupted. The guide member 38 has an L-shaped bracket 174 having an outer end which slidably receives the stem 88 of the sensing member 90, with a helical spring 176 biasing the head 92 from the second to first normal position. The device has a collar 178 secured to the stem 88 and having a depending pin 180. When the cross-seam S strikes the head 92 and moves the sensing member 90 slidebly received in the guide member from the first to second position, the pin 180 interrupts the air flow between the times 170 and 172 and actuates the switch when the sensing members is moved. The sensor may be of the type Part No. 1030 sold by Clippard of Cincinnati, Ohio. In other respects, the sewing machine operates in a manner as previously described.

The foregoing detailed description is given for clearness of understanding only, and no unnecessary limitations should be understood therefrom, as modifications will be obvious to those skilled in the art.

What is claimed is:

1. A sewing machine for sewing a fabric, comprising:

a reciprocating needle;

a hemming device comprising a guide member having an edge guide extending towards the needle, and an elongated hemming guide extending laterally from the guide member and including means for retaining the fabric in a folded configuration passing towards the needle;

means for sensing passage of a cross-seam of the fabric as it passes along the guide member;

means responsive to the sensing means for shifting the guide member and hemming guide along with the fabric laterally away from the needle while the needle penetrates the fabric in the region of the cross-seam, with the guide member and hemming guide having a fixed position relative to each other during shifting of the shifting means; and means for returning the guide member and hemming guide along with the fabric laterally to its original position.

2. The sewing machine of claim 1 including means for adjusting the lateral position of the hemming guide relative to the guide member.

3. The sewing machine of claim 1 including means for adjusting the lateral position of the hemming device relative to the needle.

4. The sewing machine of claim 1 wherein the hemming guide comprises an elongated lateral upper portion, an arcuate portion adjacent one end of the hemming guide, and a lower turned end portion directed towards the guide member.

5. The sewing machine of claim 1 including means for pivotally mounting the hemming guide to the guide member.

6. The sewing machine of claim 1 wherein the sensing means comprises a sensing member having a head located along an edge of the guide member, and a stem extending from the head and being slidably received in the guide member.

7. The sewing machine of claim 1 including a cutting device for cutting a portion of the fabric passing towards the needle.

8. A sewing machine for sewing a fabric, comprising:

a reciprocating needle;

a guide member having an edge guide extending towards the needle, said guide member being retractable a predetermined lateral distance away from the needle;

means for sensing passage of a cross-seam of the fabric as it passes along the guide member;

means responsive to the sensing means for shifting the guide member laterally away from the needle while the needle penetrates the fabric in the region of the cross-seam; and means for limiting the distance the guide member is shifted less than said predetermined distance.

9. The sewing machine of claim 8 wherein the limiting means is adjustable.

10. The sewing machine of claim 9 wherein the shifting means comprises a cylinder having a retractable piston secured to the guide member, and in which the limiting means comprises an adjustable member on the piston which strikes a fixed member whenever the piston is retracted.

11. The sewing machine of claim 8 whenever the guide member comprises an upper guide portion slidably received in a lower base portion, means for permitting the guide portion to move the predetermined distance relative to the base portion laterally away from the needle, and means for biasing the guide portion relative to the base portion laterally toward the needle.

12. The sewing machine of claim 11 including means for adjusting the force exerted by the biasing means.

13. A sewing machine for sewing a fabric, comprising:

a reciprocating needle;

a guide member having an elongated edge guide extending towards the needle, and an elongated hemming guide extending laterally from the guide member and including means for retaining the fabric in a folded configuration passing towards the needle;

means for sensing passage of a cross-seam of the fabric as it passes along the guide member;

means responsive to the sensing means for shifting the guide member and hemming guide laterally away from the needle;

means for returning the guide member and hemming guide to its original position;

first means for counting reciprocations of the needle and delaying the shifting means after sensing the cross-seam until shortly before the cross-seam reaches the needle; and second means for counting reciprocations of the needle and delaying the returning means until shortly after the cross-seam passes the needle.

14. A sewing machine for sewing a fabric, comprising:

a reciprocating needle;

a guide member having an elongated edge guide extending towards the needle;

means for sensing passage of a cross-seam of the fabric as it passes along the guide member;

pneumatic switch means responsive to the sensing means for generating a signal;

means responsive to the signal for shifting the guide member laterally away from the needle as the cross-seam approaches the needle; and means responsive to the signal for returning the guide member to its original position after the cross-seam has passed the needle.

15. The sewing machine of claim 14 wherein the sensing means comprises, a sensing member being slidably received in the guide member, and in which the switch means comprises a switch which actuates responsive to contact by the sensing member.

16. The sewing machine of claim 14 wherein the sensing means comprises an elongated rod having a turned outer end portion, and in which the switch means comprises a switch which actuates responsive to deflection of the rod.

17. The sewing machine of claim 14 wherein the switch means comprises means for passing a gas and actuating responsive to interruption of the gas passage, and in which the sensing means comprises a sensing member being slidably received in the guide member and having means for interrupting the gas passage when the sensing member is moved.

18. The sewing machine of claim 17 wherein the interrupting means comprises a pin extending from the sensing member.

19. A sewing machine for sewing a fabric, comprising:

a reciprocating needle;

a hemming device comprising a guide member having an edge guide extending towards the needle, and an elongated hemming guide extending laterally from the guide member and including means for retaining the fabric in a folded configuration passing towards the needle;

means for sensing passage of a cross-seam of the fabric as it passes along the guide member;

means responsive to the sensing means for shifting the guide member and hemming guide along with the fabric laterally away from the needle while the needle penetrates the fabric in the region of the cross-seam; and means for returning the guide member and hemming guide along with the fabric laterally to its original position including a pneumatic switch activated by said stem.

* * * * *